United States Patent [19]

Johnson

[11] Patent Number: 5,008,995

[45] Date of Patent: Apr. 23, 1991

[54] BRAKE SHOE RIVET PRESS

[75] Inventor: Bruce R. Johnson, Muskegon, Mich.

[73] Assignee: Muskegon Automation Equipment, Inc., Muskegon Heights, Mich.

[21] Appl. No.: 547,829

[22] Filed: Jul. 2, 1990

[51] Int. Cl.[5] ..... B23P 19/04

[52] U.S. Cl. ..... 29/252; 29/233

[58] Field of Search ..... 29/252, 233, 243.53; 269/71

[56] References Cited

U.S. PATENT DOCUMENTS

| | | | |
|---|---|---|---|
| 1,717,130 | 6/1929 | Weaver et al. | 29/233 |
| 2,491,119 | 12/1949 | Lewis | 29/233 |
| 2,662,960 | 12/1953 | Williams | 29/233 |
| 4,065,843 | 1/1978 | Elola | 29/252 |
| 4,586,359 | 5/1986 | Parks | 269/71 |

*Primary Examiner*—Robert C. Watson

*Attorney, Agent, or Firm*—Dykema Gossett

[57] ABSTRACT

The brake shoe rivet press is for removing in a single operation rivets which are arranged in rows to hold a fibrous liner to the base of a brake shoe to thereby permit removal and later replacement of the liner. The press has a frame and a punch holder fixedly carried by the frame. The punch holder has a plurality of movable punches also arranged in rows and corresponding in number to the number of rivets in the brake shoe. The press includes upper and lower rams movably carried by the frame on opposite sides of the punch holder. The lower ram is provided with a support surface for positioning and supporting the brake shoe and also includes a plurality of openings arranged in rows for receiving the spent rivets. The upper ram has an operating surface, which, when the upper ram is actuated, engages the punches so as to urge them against the rivets to remove them from the brake shoe in a single operation. A hydraulic circuit is provided for controlling the movements of the upper and lower rams.

10 Claims, 4 Drawing Sheets

BRAKE SHOE RIVET PRESS

BACKGROUND OF THE INVENTION

When heavy duty truck shoe brake shoes become worn, it is necessary to remove and then replace the fibrous pads. This is generally accomplished by removing the rivets one or a few at a time. Generally, there are two or more rows of rivets securing the fibrous pad to the base of the brake shoe. One typical design of brake shoes has thirty-two (32) rivets, eight rows of four rivets each. Generally, it takes much time and labor including a considerable number of machine operations to remove all of the rivets.

It is therefore an object of the present invention to design a brake shoe rivet press which will remove all rivets from the corresponding brake shoe in one hit or in a single operation thereby resulting in a savings in time and labor.

SUMMARY OF THE INVENTION

The brake shoe rivet press is for removing in a single operation or hit rivets from a brake shoe having a liner or pad secured thereto by the rivets. This is accomplished by providing a frame and a punch holder fixedly carried by the frame having a plurality of punches arranged in rows matching the rows of rivets in the brake shoe. The upper and lower surfaces on the stationary punch holder are of arcuate configuration following the contour of the brake shoe.

The brake shoe rivet press further includes upper and lower movable rams, on opposite sides of the punch holder. The surfaces of the upper and lower rams are also of arcuate configuration in order to conform to the configuration of the brake shoe and to the arcuate configuration of the upper and lower surfaces provided on the punch holder. The lower ram supports the brake shoe and the upper ram activates the punches and thereby strike or remove the rivets from the brake shoe.

Due to the curvature of the brake shoe, the punch holder is provided with a plurality of openings arranged in rows, with the openings in each row having non parallel axes having generally the same center. Punches are provided in the openings and are movably carried by the punch holder. The punches in each row have the same non parallel axes as the holes and are activated by the upper movable ram to strike or remove the rivets from the brake shoe.

The brake shoe rivet press is provided with a closed hydraulic circuit having a reservoir, hydraulic pump and motor and a hydraulic cylinder for vertically adjusting or moving each of the upper and lower rams. The hydraulic cylinder for the lower ram positions the brake shoe against the arcuate lower surface of the punch holder. The vertical adjust hydraulic cylinder for the upper ram moves the arcuate operating surface towards and against the punches to operate same and thereby strike and remove the rivets from the brake shoe.

The brake shoe rivet press further includes a third or horizontal adjust hydraulic cylinder as part of the hydraulic circuit which is corrected to a slide or shuttle to which the upper ram is secured. The upper ram may be provided with one or more openings in the arcuate operating surface to permit a corresponding punch in the punch holder to be received and rendered inoperative when the upper ram activates the other punches to strike corresponding rivets from the brake shoe.

The hydraulic circuit is provided with a 4-way directional control valve for each cylinder to direct the movement of the upper and lower rams.

With such a construction, the brake shoe rivet press may strike all rivets from a brake shoe in a single operation or hit to thereby permit removal and later replacement of the fibrous liner or pad.

The spent rivets fall through the openings provided in the lower ram where they are collected in a tray provided on the press beneath the lower ram. The spent rivets are later discarded.

The press includes a base upon which the frame is mounted. The hydraulic circuit, reservoir, pump and motor and other components are mounted in the interior of the base where they are available for maintenance purposes.

Electrical controls and circuitry are located in an electrical panel provided at one side of the base of the press for providing the electrical program for the press.

DESCRIPTION OF THE PREFERRED EMBODIMENT OF THE INVENTION

Figure 1:
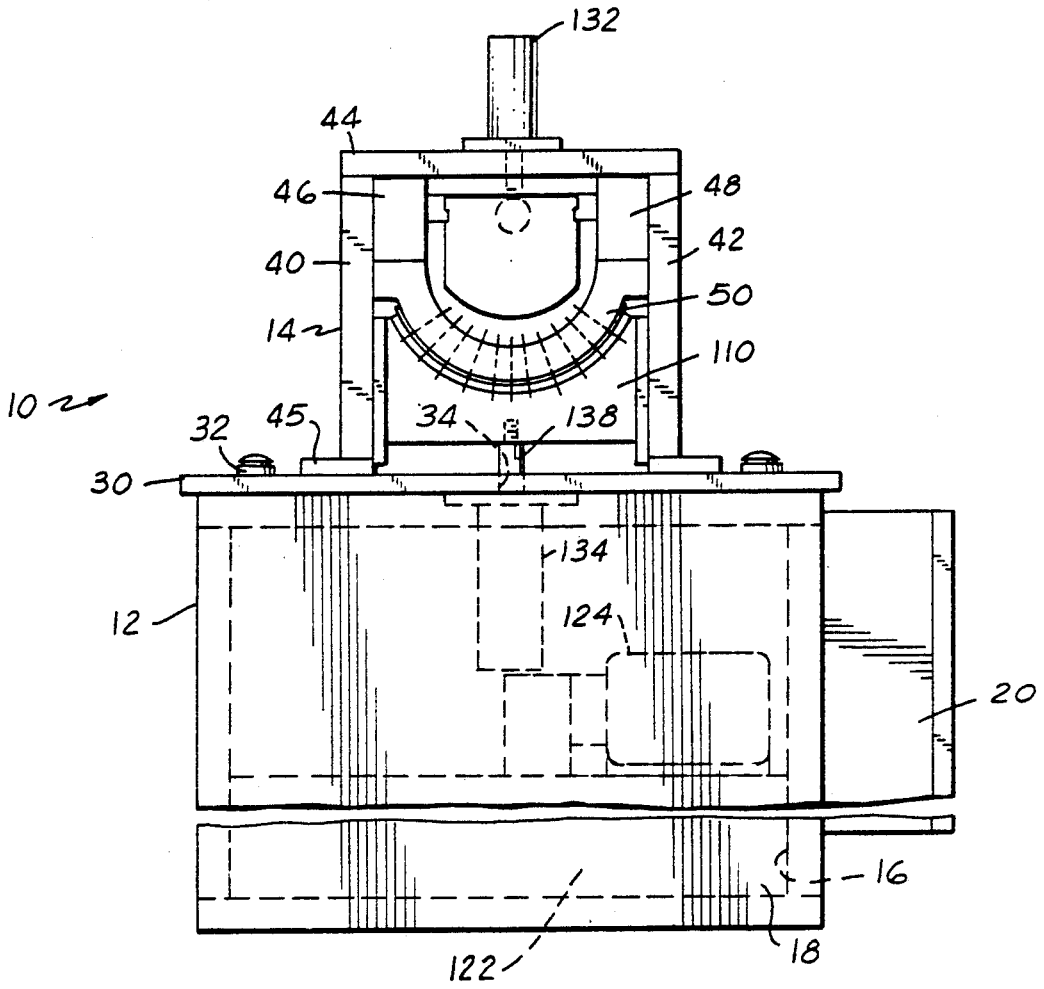
FIG. 1 is a fragmentary elevational view of the brake shoe rivet press.
Figure 2:
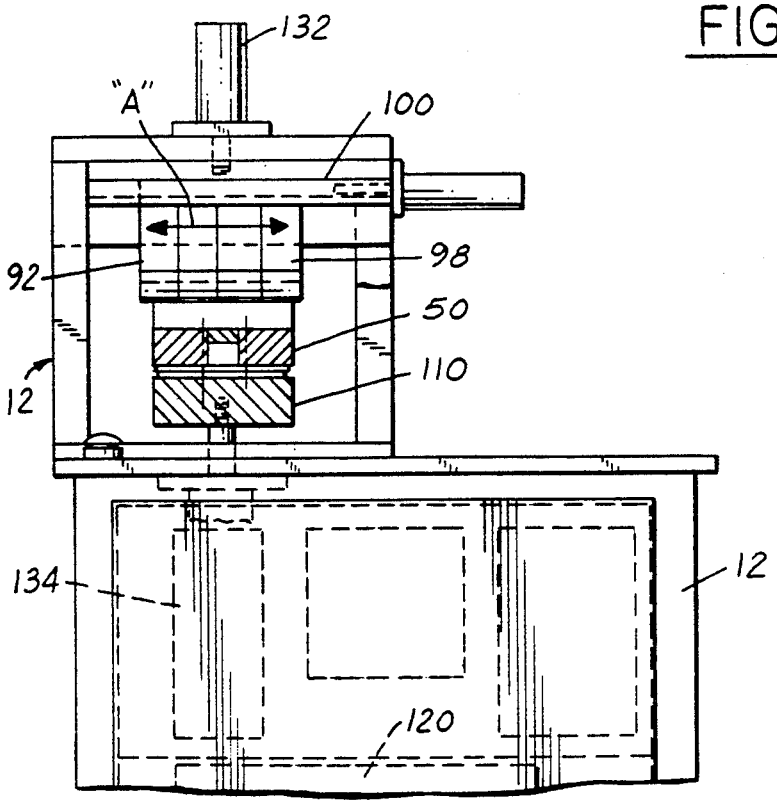
FIG. 2 is a fragmentary right side view, partly in section, of the press.

The brake shoe rivet press or apparatus 10 includes a base or housing 12 and a frame 14 suitably mounted on the base 12. The base 12 is a metal enclosure consisting of tubular elements 16 and sheet metal panels 18 around the four sides of the base 12. The back or rear panel of the base 12 is removable to permit access to the interior thereof where the hydraulic components are stored as will hereinafter be enumerated. An electrical panel 20 is provided at one side of the base 12 for mounting the electrical components for controlling the hydraulic operations of the press 10.

A base plate 30 is mounted on the top of the base 12 and is appropriately secured thereto by suitable fastening devices 32. Plate 30 is provided with a centrally located opening 34 for a purpose to be hereinafter indicated.

The frame 14 includes side members 40 and 42 and a cross member 44. The members 40 and 42 are spaced apart and are provided with flanges 45 which are secured to the top plate 30. Corner elements 46 and 48 are appropriately secured to the cross member 44 by bolting or otherwise. The corner elements 46, 48 are secured to the frame 14 and provide support for the punch holder 50. The punch holder 50 has a pair of laterally extending flanges 52, an inner arcuate surface 54 and an outer arcuate surface 56 matching or following the arcuate configuration of the truck brake shoe 64. The punch holder 50 is secured to the corner supports 46, 48 by the bolts 60.

Figure 3:
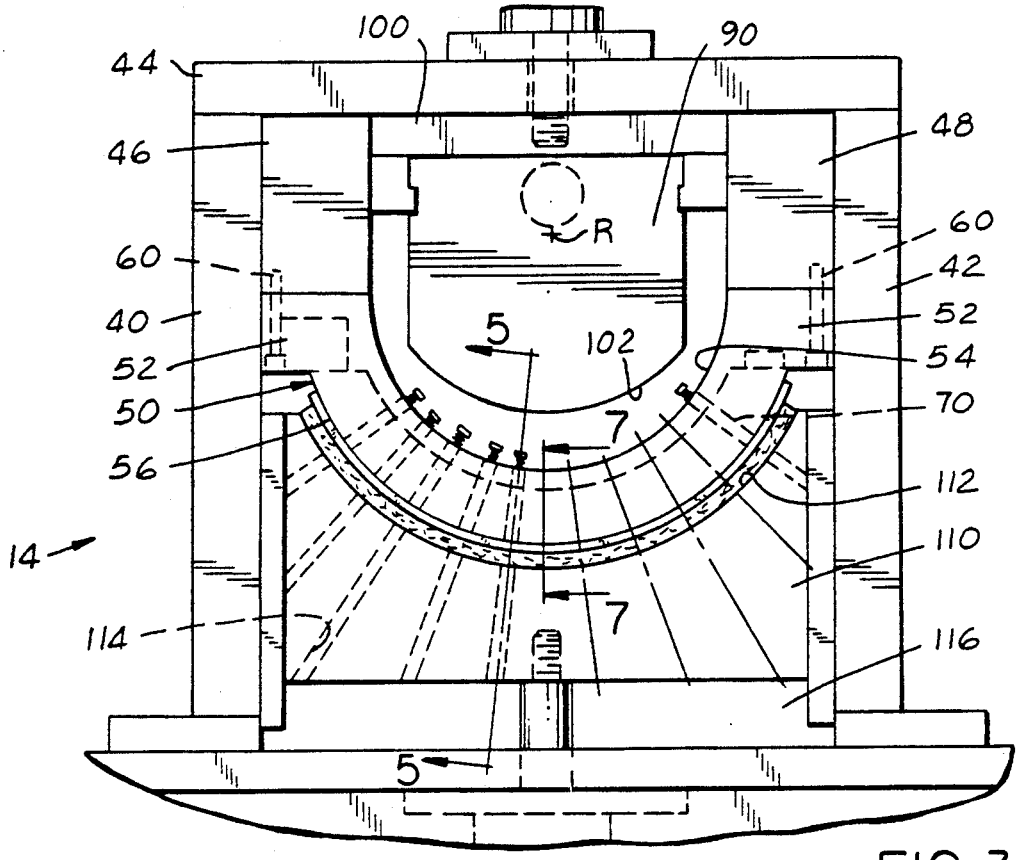
FIG. 3 is an enlarged fragmentary elevational view of the punch holder forming part of the press which is fragmentarily shown, with the upper ram out of engagement with the punches.
Figure 5:
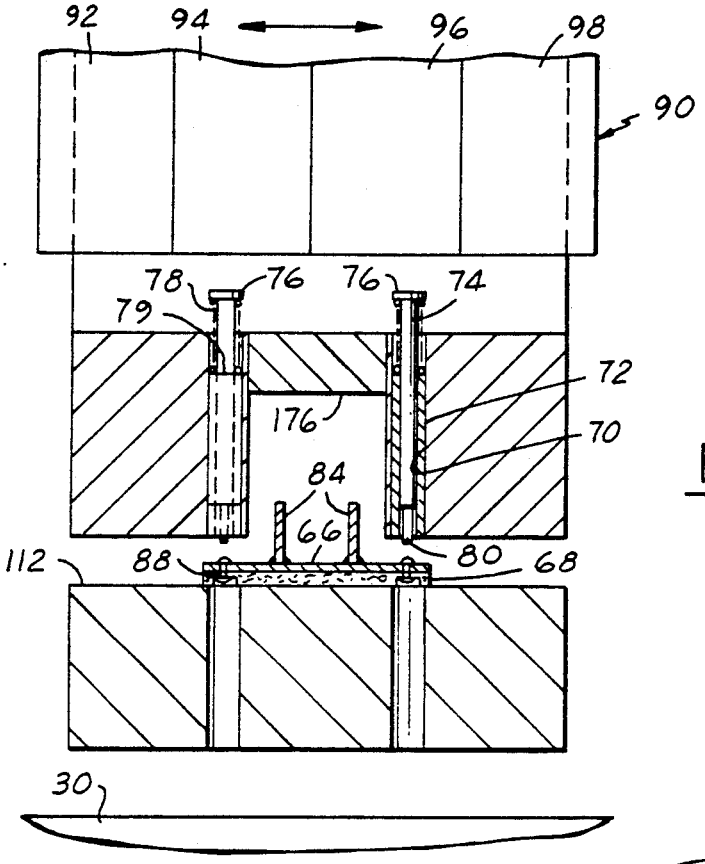
FIG. 5 is a sectional view through the punch holder and lower ram of the press taken generally taken generally taken on the line 5—5 of FIG. 3.
Figure 6:
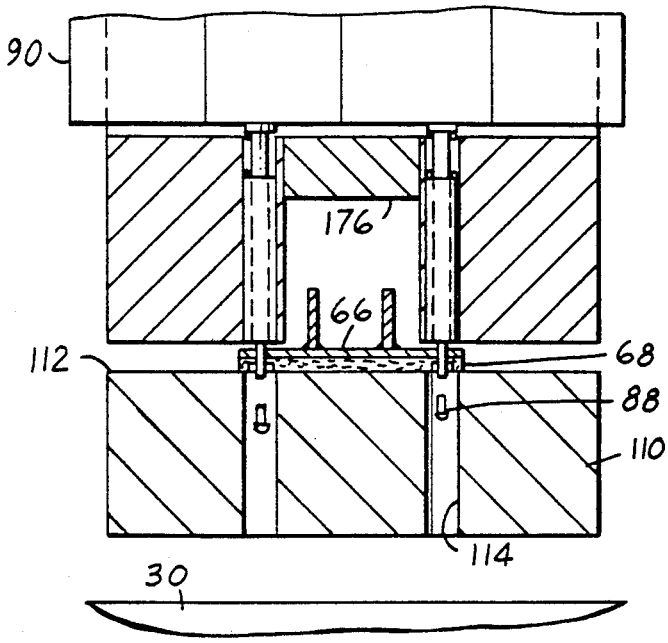
FIG. 6 is a sectional view through the punch holder and lower ram taken generally taken on the line 6—6 of FIG. 4.
Figure 7:
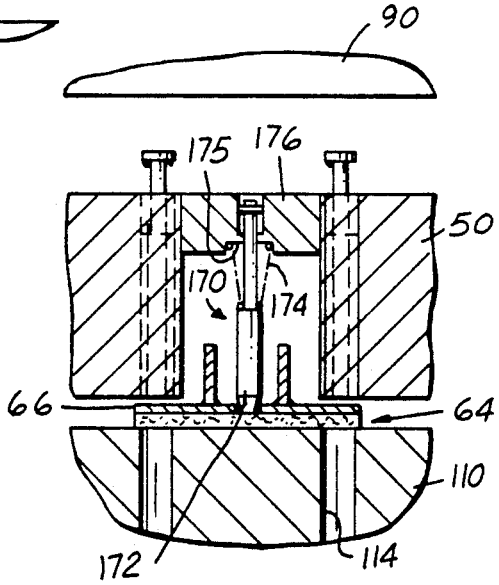
FIG. 7 is a sectional view taken generally on the line 7—7 of FIG. 3 and illustrating the spring bias locating pin for centering the brake shoe in proper position on the support surface of the lower ram.
Figure 8:
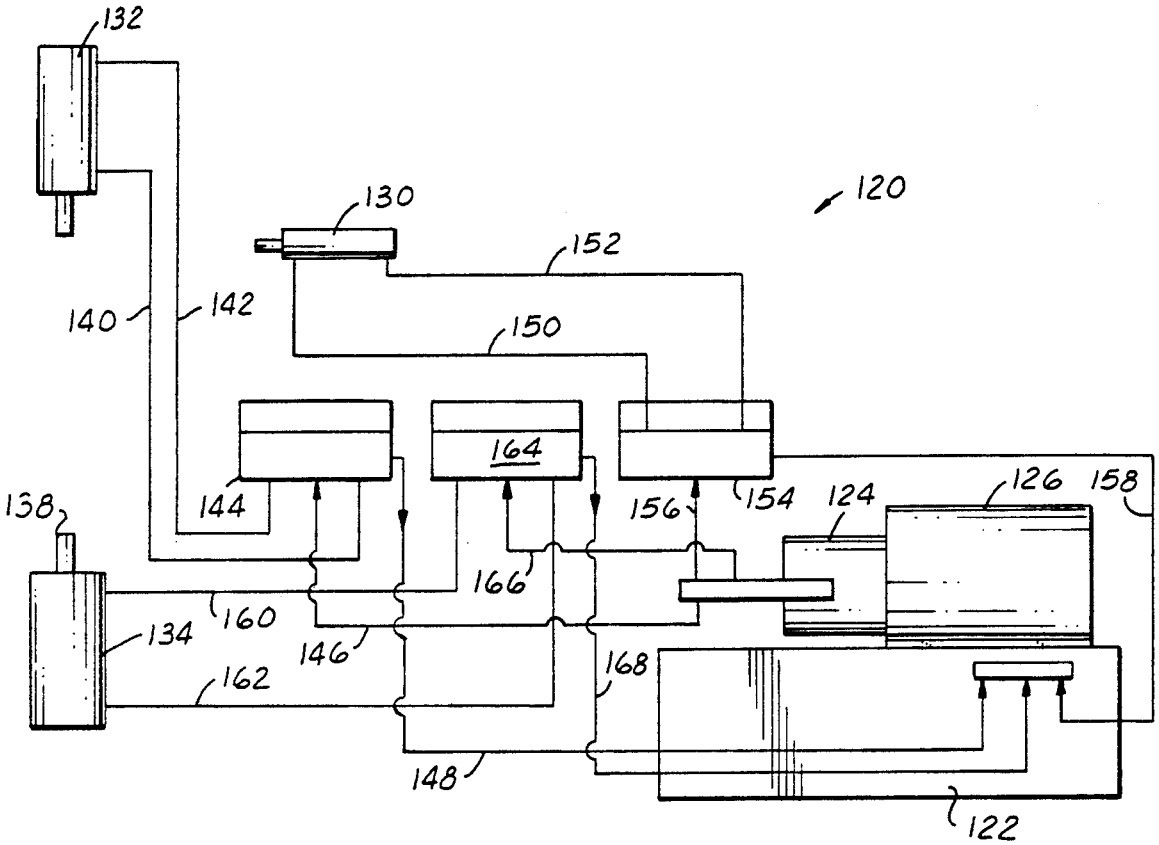
FIG. 8 is a diagram of the hydraulic circuit, including the hydraulic cylinders for the brake shoe rivet press.

The punch holder 50 has a plurality of parallel rows of openings 70 provided therein. While the rows of openings are parallel to one another as shown in FIGS. 5–7, the openings 70 in each row are not parallel as noted in FIGS. 1, 3 and 4. Each opening 70 is elongated and has an axis which extends through the center "R". The axes of the openings 70 in each row intersect "R". Each opening 70 is provided with a tubular sleeve 72 fixedly carried by the punch holder 50. The sleeve or element 70 has a height which is less than the height of the punch holder 50 as illustrated in FIGS. 6 and 7.

Located in each punch hole sleeve or element 72 is a reciprocally movable punch 74 having an enlarged head 76 at the upper end thereof. The punch 74 has a length greater than the length or height of the punch holder 50 as noted in FIGS. 5 and 6. Each punch 74 has a spring 78 interposed between the top surface 79 of the tubular element 72 and the head 76 provided on the punch 74. The opposite end of the punch 74 has a piercing, striking or punching element 80 having an outside diameter which is less than the inside diameter of the tubular element or sleeve 72. The piercing or punching element 80 is designed to strike the corresponding rivet in the truck brake shoe and to remove it therefrom.

Figure 9:
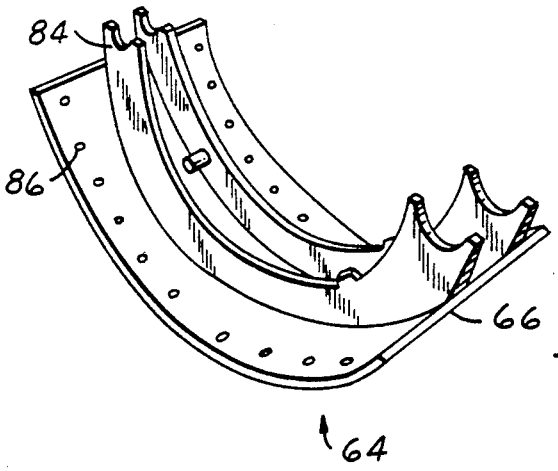
FIG. 9 is a base of brake shoe illustrating, as an example, two rows of rivet holes.

Referring to FIG. 9, the truck brake shoe 64 has a metal base 66, a fibrous liner 68 (see FIG. 5), a pair of upstanding flanges 84 and two parallel rows of openings 86 for the rivets 88 (FIGS. 5 and 6) which secure the fibrous liner 68 to the brake shoe base 66.

While FIG. 9 illustrates a brake shoe having a pair of parallel rows of openings 86, each row having 10 openings therein, it should be understood that many truck brake shoes contain a different number of rivets. As an example, one common truck brake shoe utilizes 32 rivets, there being 8 rows of rivets of 4 each. It should be appreciated that a press or apparatus designed for a 32 rivet brake shoe may also be used, as an example, with a brake shoe having 28 rivets or even fewer rivets.

The brake shoe press 10 further includes upper and lower movable rams 90 and 110 respectively. The upper ram 90 is made from four steel sections or elements 92, 94, 96 and 98. The elements 92–98 are bolted to a horizontal slide 100. It is been found that it is easier to machine the upper ram 90 if the sections are made in small elements bolted to the slide 100 rather than having to machine one large piece of metal or steel. The upper ram 90 is movable horizontally, in the direction of arrows "A", and also vertically by hydraulic cylinders to be subsequently described.

Figure 4:
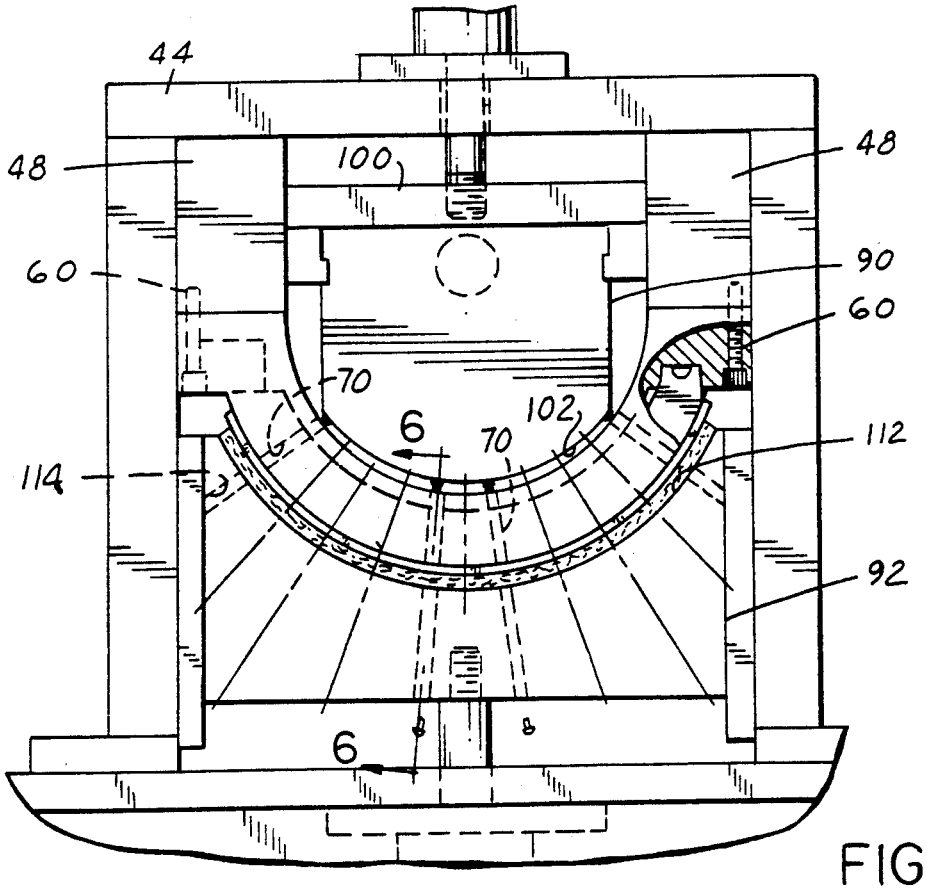
FIG. 4 is a view similar to FIG. 3 but illustrating the upper ram of the press in engagement with the punches so as to displace or remove the rivet from the brake shoe.

The upper ram 90 is provided with an arcuate actuating surface 102 having the center "R" (FIG. 3) so that the punches 74 may be struck simultaneously as the vertical upper ram 90 is lowered as shown in FIG. 4.

The lower ram 110 is located below the stationary or fixed punch holder 50. The ram 110 has an arcuate support surface 112 generally conforming to the configuration of the brake shoe 64 and to the arcuate configuration of the upper and lower surfaces 54, 56 provided on the punch holder 50. The lower ram 110 supports the brake shoe in the proper position thereon so that the punches 74, when actuated by the upper ram 90, strike the rivets 88 from the truck brake shoe 64 in a single pass or operation.

The lower ram 110 is also provided with rows of openings 114 corresponding in number to the number of openings provided in the punch holder 50. The opening 114 have the same axes as the openings 70 provided in the punch holder 50. The openings 114 extend through the ram 110 so that the spent or stricken rivets 88 may drop by gravity through the opening 114 provided in the ram 110 to a collection area or zone 116 provided at the bottom of the ram 110. As an example, a collection tray may be provided for collecting the spent rivets 88 from the brake shoe 64.

The brake shoe rivet press 10 is provided with a closed hydraulic circuit 120 having a tank or reservoir 122, a hydraulic pump 124 driven by a motor 126 and three hydraulic cylinders 130, 132 and 134. Cylinder 130 is connected to the upper slide 100 and, when actuated, moves the slide 100 and the upper ram 90 horizontally. Thus, cylinder 130 is sometime referred to as a horizontal adjust cylinder.

Slide 100 also carries the upper ram 90 and means provided for providing a vertical adjustment thereto. This includes hydraulic cylinder 132 which is sometime referred to as the upper ram vertical adjust cylinder. Cylinder 134 includes a rod 138 which extends through the opening 34 in plate 30 and is connected to the lower ram 110. Cylinder 134 is designed to provide a vertical adjustment for the lower ram 110 in order to bring the centered brake shoe into contact with the stationary punch holder 50.

Further describing the hydraulic circuit 120, each hydraulic cylinder 130, 132 and 134 is connected by a 4-way valve to the reservoir 122 and the hydraulic pump 124. The upper ram cylinder 130 is connected by hydraulic lines 140 and 142 to the 4-way valve 144. Four-way valve 144 is connected to the hydraulic pump 124 by line or conduit 146 and to the reservoir 122 by line 148.

The horizontal slide cylinder 130 for the upper ram 90 is connected by conduits or lines 150 and 152 to the 4-way directional control valve 154. The last mentioned valve 154 is connected by conduits 156 and 158 to the hydraulic pump 124 and the reservoir 122 respectively.

Finally, the lower ram cylinder 134 is connected by conduits or lines 160 and 162 to the 4-way directional control valve 164. This last mentioned valve is connected by lines or conduits 166 and 168 to the hydraulic pump 124 and to the reservoir 122 respectively.

An electrical control panel 20 is provided with appropriate control elements including a starter, fuses, transformers, terminal blocks, a fusible disconnect and a General Electric Series One Programable Controller for controlling the operation of the press 10 and the operating components forming part of the hydraulic circuit 120.

In operation, it is necessary to have the upper ram 90 in a raised position out of contact with the punches 74 carried by the punch holder 50. The lower ram cylinder 134 is in a lower position and the brake shoe 64 is placed on the support surface 112 of the lower ram 110. It is important that the brake shoe be appropriately centered or placed on the lower ram 110 so that the punches 74 will be aligned with the rivets 88 provided in the brake shoe.

In order to center the brake shoe, the punch holder 50 is provided with a spring bias locating device 170 which includes a locating pin or element 172 and a spring 174 as shown in FIG. 7. The locating pin 172 is designed to be received within an opening or recess provided in the base 66 of the brake shoe 64 as shown in FIG. 7. The spring 174 has one each biasing the locating pin 172 towards the brake shoe with the other end of the spring 174 located in a recess 175 provided in the center support 176 of the punch holder 50.

Once the truck brake shoe has been properly positioned on the movable lower ram 110, and the lower vertical adjust cylinder 134 is actuated so as to raise the lower ram 110 and bring the brake shoe into centering location with the punch holder 50 as shown in FIGS. 4 and 6. Thereafter, it is necessary to adjust the horizontal slide 100 so as to properly locate the upper ram 90 with respect to the punch holder 50. Once this has been accomplished, it is necessary to vertically adjust the upper ram 90 and to urge the operating surface 102 provided thereon against the punches 74 as shown in FIGS. 4 and 6 by activating the vertical adjust cylinder 132. This urges the punching elements 80 into the truck brake shoe 64 to strike the rows of rivets 88 therefrom. This is accomplished in a single pass, hit or strike operation, thereby resulting in a considerable savings of time and labor.

Once the rivets have been removed, it is necessary to open the press 10 by raising the upper ram 90 by reversing the flow of the hydraulic fluid in the cylinder 132, lowering the lower ram 110 by reversing the hydraulic fluid directed to the cylinder 134 and thereafter removing the worn fibrous liner 68 and the base 66 of the truck brake shoe 84 from the lower ram 110. It takes only 5 to 8 seconds to accomplish the striking of the rivets from a brake shoe.

Thus, the upper and lower rams each include a hydraulic cylinder for adjusting the position of the corresponding ram with respect to the punch holder to permit loading and unloading of the brake shoe and the liner from the press. In addition, the upper ram 90 also includes a hydraulic cylinder 130 for adjusting the horizontal position thereof with respect to the punch holder 50. The upper ram 90 may be provided with one or more holes, not shown, in the operating surface 102 which receive the corresponding punch or punches in the punch holder 50 that are not to be engaged or operated when the upper ram is activated and moved from the position shown in FIG. 3 to the position shown in FIG. 4.

What I claim is:

1. A brake shoe rivet press for removing in a single operation rivets arranged in rows to hold a liner to the base of a brake shoe to thereby permit removal and later replacement of the liner thereon, comprising:

a frame;

a punch holder fixedly carried by said frame and having a plurality of movable punches arranged in rows;

upper and lower rams movably carried by said frame on opposite sides of said punch holder;

said lower ram having a support surface for positioning and supporting the brake shoe and further including a plurality of openings arranged in rows for receiving the spent rivets;

said upper ram having an operating surface, which, when the upper ram is actuated, engages the punches so as to urge them against the rivets to remove them from the brake shoe in a single operation;

said upper ram includes one or more holes in said operation surface to receive and thereby permit the corresponding punch or punches not to be engaged when said upper ram is activated; and said upper ram includes a hydraulic cylinder for adjusting the horizontal position of said upper ram with respect to the punch holder to selectively align said holes with said punches.

2. The brake shoe rivet press as recited in claim 1 wherein each of said upper and lower rams include a hydraulic cylinder for adjusting the vertical position of the corresponding ram with respect to the punch holder.

3. The brake shoe rivet press as recited in claim 1 wherein said punch holder have upper and lower accurate surfaces.

4. The brake shoe rivet press as recited in claim 3 wherein said the support surface of said lower ram is accurate and conforms to the accurate configuration of the brake shoe.

5. The brake shoe rivet press as recited in claim 4 wherein the brake shoe liner engages the arcuate support surface.

6. The brake shoe rivet press as recited in claim 4 wherein said punches are arranged in rows, with the punches in each row having non parallel axes having generally the same center.

7. The brake shoe rivet press as recited in claim 8 wherein the plurality of openings provided in said lower ram have non parallel axes having the same center as do the axes of said punches.

8. The brake shoe rivet press as recited in claim 1 wherein each cylinder is located in a hydraulic circuit having a hydraulic pump and motor, reservoir and valve means between said pump and motor and said cylinders for controlling the flow of hydraulic fluid between the reservoir and the cylinders.

9. The brake shoe rivet press as recited in claim 8 wherein said valve means include a 4-way directional control valve for each cylinder.

10. The brake shoe rivet press as recited in claim 1 wherein said punch holder is provided with a spring bias locating pin for centering the brake shoe in the proper position on the support surface of the lower ram.

* * * * *